US005722245A

United States Patent [19]

Ponder

[11] Patent Number: 5,722,245

[45] Date of Patent: Mar. 3, 1998

[54] MICROWAVE HEAT PUMP DEFROSTER

[76] Inventor: Henderson Frank Ponder, P.O. Box 145, Summerville, Ga. 30747

[21] Appl. No.: 704,449

[22] Filed: Aug. 27, 1996

[51] Int. Cl.[6] ..... F25D 21/06

[52] U.S. Cl. ..... 62/80; 62/155; 62/176.2; 62/276; 62/324.5; 165/231

[58] Field of Search ..... 62/151, 155, 234, 62/275, 276, 324.5, 80, 176.2, 156; 165/240, 241, 242, 231, 232, 233

[56] References Cited

U.S. PATENT DOCUMENTS

| | | | |
|---|---|---|---|
| 1,821,754 | 9/1931 | Huyette . | |
| 2,110,693 | 3/1938 | Bailey . | |
| 2,195,924 | 4/1940 | Hoesel . | |
| 2,297,970 | 10/1942 | Merz . | |
| 2,401,560 | 6/1946 | Graham et al. . | |
| 2,474,304 | 6/1949 | Clancy . | |
| 2,780,442 | 2/1957 | Breeding . | |
| 2,793,834 | 5/1957 | Henney et al. . | |
| 2,806,674 | 9/1957 | Biehn . | |
| 2,919,558 | 1/1960 | Lauer . | |
| 2,970,816 | 2/1961 | McCarty . | |
| 3,006,613 | 10/1961 | Coyne . | |
| 3,103,794 | 9/1963 | Kyle et al. . | |
| 3,135,317 | 6/1964 | Goettl | 62/276 X |
| 3,176,760 | 4/1965 | Murdoch . | |
| 3,189,085 | 6/1965 | Eberhart . | |
| 3,219,102 | 11/1965 | Taylor . | |
| 3,318,372 | 5/1967 | Shell . | |
| 3,444,923 | 5/1969 | Kyle et al. . | |
| 3,529,659 | 9/1970 | Trask . | |
| 3,759,049 | 9/1973 | Bell et al. | 62/176.2 X |
| 3,867,979 | 2/1975 | Carrasse et al. . | |
| 4,102,389 | 7/1978 | Willis . | |
| 4,102,391 | 7/1978 | Noland et al. . | |
| 4,105,064 | 8/1978 | Del Toro et al. . | |
| 4,112,705 | 9/1978 | Sisk et al. . | |
| 4,143,707 | 3/1979 | Lewis et al. . | |
| 4,373,350 | 2/1983 | Noland . | |
| 4,751,825 | 6/1988 | Voorhis et al. | 62/155 X |
| 5,179,841 | 1/1993 | Phillips et al. | 62/234 X |

*Primary Examiner*—Harry B. Tanner

[57] ABSTRACT

A microwave heat pump defroster system, utilizing a magnetron tube, or other microwave energy generating device, for the application of heat to the external surfaces of the outside coil of an electric heat pump, while the heat pump is operating in the heating mode for the following purposes, (1) to defrost the outside coil of the heat pump, (2) to inhibit the accumulation of frost on the external surfaces of the outside coil of the heat pump, and (3) to allow heat so applied to the external surfaces of the outside coil of the heat pump to be absorbed into the heat pump system via the outside coil of the heat pump, in a manner that will improve the efficiency of the heat pump.

14 Claims, 1 Drawing Sheet

MICROWAVE HEAT PUMP DEFROSTER

BACKGROUND OF THE INVENTION

This invention relates in general to air conditioning systems usually referred to as electric heat pumps, which utilize reverse cycle refrigeration apparatus to condition air inside a building for heating in the winter months, and for cooling in the summer months, and relates in particular to the application of heat to the external surfaces of the outside coil of an electric heat pump for the purpose of defrosting, and/or inhibiting the accumulation of frost on the external surfaces of the outside coil of an electric heat pump, and further relates to causing such heat to be absorbed into the heat pump system via the outside coil of an electric heat pump for maximum heat economy.

The use of heat to defrost the outside coil of an electric heat pump is old and well known. However, the typical method is to reverse the flow of refrigerant (usually Freon) inside the system so that the inside coil of the heat pump which is used as a condenser when the heat pump is operating in the heating mode, is coverted to an evaporator, causing that coil to become cold, and the outside coil which is used as an evaporator when the heat pump is operating in the heating mode, is coverted to a condenser, causing that coil to become hot. In reality, the heat pump is coverted to an air conditioner for the duration of the defrost cycle.

Consequently, heat pumps of the prior art operate to collect heat from inside a building and to use such heat to defrost the outside coil of the heat pump, which is changed to a condenser for the duration of the defrost cycle, allowing such heat to radiate into the ambient air outside the building and to be lost. The system is thus required to operate for a considerable amount of time after returning to the heating mode, just to recover the heat lost during the defrost cycle, and as a result, the efficiency of the heat pump is diminished considerably.

In general terms, when an electric heat pump is operating in the heating mode, a liquid refrigerant such as Freon is pumped through a system of pipes, valves and coils. When it passes through the outside coil, a heat exchanger coil which is disposed outside the area to be heated, the refrigerant becomes very cold as it changes from liquid to vapor. Heat is absorbed into the system as ambient air is caused to pass over and through the external surfaces of the outside coil of the heat pump, by a fan. The refrigerant is then passed through a compressor, which increases both its pressure and temperature. From there, the heated vapor goes to the inside coil, a heat exchanger coil which is disposed inside a warm air duct, where the heat is absorbed and carried inside the area to be heated. When it passes through the inside coil the refrigerant is condensed, changing back to a liquid. It then flows through a valve and back to the outside coil to continue the cycle.

In the air conditioning mode, a reversing valve changes the direction in which the refrigerant moves through the system. This causes the inside coil to act as an evaporator and the outside coil to act as a condenser. Heat is thus absorbed from the air inside the building and discharged outside.

When the conventional heat pump requires defrosting, the flow of refrigerant is reversed and the heat pump is converted to an air conditioner for the duration of the defrost cycle. While the system is operating in the defrost mode, heat is absorbed from inside the building and discharged into the ambient air outside. Consequently, the building requiting heat, looses heat instead.

Furthermore, many heat pumps have disposed therein, usually near the inside coil, a number of electric heat elements which are used to supply additional heat when needed or desired. Switching devises are used to turn these heat elements on during the defrost cycle in an effort to restore to the building some of the heat lost when the flow of refrigerant is reversed. However, much of the heat generated by these heat elements radiates directly to the inside coil which is then the coldest object in the vicinity. This is due to the fact that heat always moves from a warm body to a cold body. Since heat radiates at a speed which is many thousand times faster than the speed of the air passing through the air duct, it should be obvious that much of the heat generated by the heat elements, especially heat that is radiated from the back side of the heat elements, will go to the inside coil of the heat pump, which is then operating as an evaporator, and be absorbed into the heat pump system and carried to the outside coil where it is wasted to the ambient air.

SUMMARY OF INVENTION

Accordingly, it is an object of the present invention to provide a microwave heat pump defroster system, utilizing a magnetron tube, or other microwave energy generating device, referred to hereinafter as "microwave energy means", for the application of heat to the external surfaces of the outside coil of an electric heat pump, for the purpose of defrosting the outside coil of an electric heat pump.

It is another object of the present invention to provide a microwave heat pump defroster system for the application of heat to the external surfaces of the outside coil of an electric heat pump, for the purpose of inhibiting the accumulation of frost on the outside coil of an electric heat pump.

It is yet another object of the present invention to provide a microwave heat pump defroster system for the application of heat to the external surfaces of the outside coil of an electric heat pump, while the heat pump is operating in the heating mode.

It is still another object of the present invention to provide a microwave heat pump defroster system for the application of heat to the external surfaces of the outside coil of an electric heat pump, without the need to reverse the flow of refrigerant inside the heat pump system.

Test show that when an electric heat pump is operating in the heating mode, more heat is collected from a given volume of air when the temperature of the air is high than is collected from the same volume of air at a lower temperature. Further test show that the temperature of air exiting the outside coil of an electric heat pump remains approximately the same when the temperature of the air entering the outside coil is raised by heat from an external source, and at the same time, the temperature of the air exiting the inside coil is higher. This proves that additional heat applied to the external surfaces of the outside coil of an electric heat pump is absorbed, and carried through the heat pump system to the inside coil where it is discharged into the building.

Therefore, it is also an object of the present invention to provide a microwave heat pump defroster system for the application of heat to the external surfaces of the outside coil of an electric heat pump, that will allow such heat to be absorbed into the outside coil of the heat pump to improve the economy thereof.

The nature and objects of the present invention will become more readily apparent from the following description of a preferred embodiment, as described below and shown in the attached drawings.

DESCRIPTION OF A PREFERRED EMBODIMENT

Figure 1:
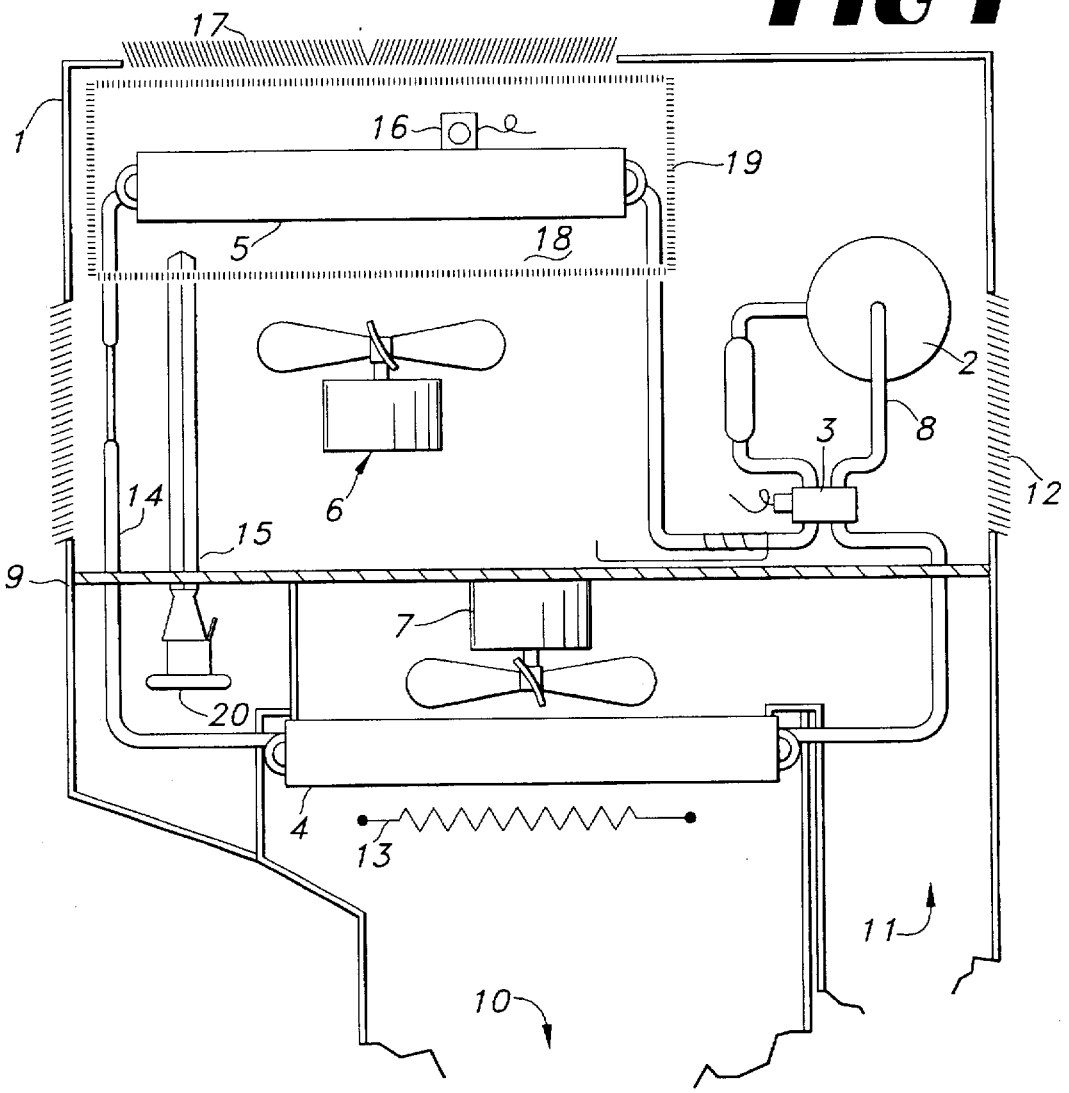
FIG. 1 shows a pictorial view of a conventional electric heat pump with added apparatus 15, 16, 17, 18, 19, and 20, which are parts of the present invention.

Turning first to FIG. 1, there is shown generally at 1 the embodiment of an electric heat pump, at 2 a compressor, at 3 a reversing valve, at 4 an inside heat exchanger coil, at 5 an outside heat exchanger coil, at 6 a fan, at 7 a fan, at 8 a pipe, at 9 a partition, at 10 a warm air duct, at 11 a return air duct, at 12 a system of louvers, at 13 an electric heat element, at 14 a pipe, at 15 a microwave energy transmission channel, referred to hereinafter as a wave guide, at 16 a humidity controlled circuit breaker, at 17 a system of louvers, at 18 an enclosure, at 19 a metallic screen, and at 20, a microwave energy means.

In addition to the regular components of an electric heat pump which are well known to all concerned, the microwave energy means shown at 20 is disposed to generate microwave energy for the purpose of defrosting the outside coil of the heat pump. The wave guide shown at 15 is disposed to deliver microwave energy from the microwave energy means at 20, to the enclosure at 18. The enclosure shown at 18 is disposed to contain microwave energy within, when the heat pump is operating in the defrost mode. The screen shown at 19 forms the walls of the enclosure at 18. The screen is similar to such screens found in the doors of microwave ovens, and should completely encompass the outside coil of the heat pump. The screen should be large enough to allow ambient air to freely flow through the enclosure, and to allow microwave energy to pass around the outside coil of the heat pump from the top, the bottom, and both sides. The humidity controlled circuit breaker shown at 16 is disposed to open and close a segment of the power circuit shown at FIG. 2. The louvers shown at 17 are disposed to protect the screen 19 from excessive precipitation, especially precipitation in the form of snow, or ice. The louvers should be wide enough to prevent snow and ice from forming over the openings which would cut off the flow of ambient air through the enclosure.

The microwave heat pump defroster system of the present invention will act to defrost the outside coil of an electric heat pump while the heat pump is operating in the heating mode. In other words, the flow of refrigerant will not change. The inside coil of the heat pump will continue to function as a condenser, and the outside coil will continue to function as an evaporator.

When it is determined that the outside coil of the heat pump requires defrosting, switching devices (explained later herein) will act to energize the microwave energy means, 20 FIG. 1, which in turn will commence to generate microwave energy. The microwave energy will be transmitted via the wave guide, 15 FIG. 1 to the enclosure, 18 FIG. 1, which houses the outside coil of the heat pump. Inside the enclosure, the microwave energy will be contained by means of the screen, 19 FIG. 1, which forms the walls of the enclosure. The microwave energy will be absorbed into the molecules of frost and ice accumulated on the external surfaces of the outside coil of the heat pump, much in the same manner that microwave energy is absorbed into the molecules of food inside a microwave oven. Consequently, heat will be created directly on the external surfaces of the outside coil of the heat pump. The heat will act to defrost the outside coil, and at the same time, because the coil is functioning as an evaporator, will be absorbed into the heat pump system in the same manner that heat from ambient air is absorbed.

It will be understood that the microwave energy means shown at 20 FIG. 1 could be disposed directly within the enclosure means at 18 FIG. 1, provided however, that the microwave energy means is protected from excessive moisture within some kind of protective shield. This would eliminate the need for the wave guide shown at 15 FIG. 1.

Figure 2:
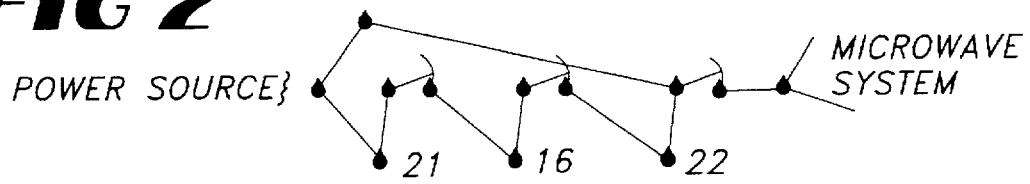
FIG. 2 show a functional schematic diagram of a control system to operate the microwave energy means shown at 20, FIG. 1.

Turning now to FIG. 2, there is shown a schematic diagram of a system designed to control the operation of the microwave energy means shown at 20 FIG. 1. At 21, there is shown a defrost demand switch, at 16, a humidity controlled circuit breaker, also shown in the drawing at FIG. 1, and at 22, a solenoid. Each of the above devices, 21 and 16, serve to open and close a segment of the power circuit disposed to energize the solenoid at 22, which in turn will act to energize the microwave energy means.

The defrost demand switch shown at 21 is in reality the contact switch of a device already in use in electric heat pumps of the prior an and will be explained in detail later herein. In an electric heat pump utilizing the present invention, the defrost demand switch is disposed to open and close a segment of the power circuit leading to the solenoid shown at 22. The humidity controlled circuit breaker shown at 16, also shown in the drawing at FIG. 1, is disposed to open and close a segment of the power circuit leading to the solenoid at 22, which in turn will act to energize, and de-energize the microwave energy means. Solenoid 22 is connected directly to the power circuit leading to the microwave energy means at 20 FIG. 1.

When the device at 21 is turned on, indicating that the outside coil of the heat pump requires defrosting, the switch at 21 will close and power will be allowed to pass and flow to the humidity controlled circuit breaker 16 FIG. 1. When circuit breaker 16 determines that sufficient humidity is within the enclosure 18 to absorb the microwave energy, the switch at 16 will close and power will be allowed to pass and flow to the solenoid at 22. When the solenoid 22 is energized, the switch at 22 will close causing power to flow to the microwave energy means, 20 FIG. 1, and the defrost cycle will begin. If desired, solenoid 22 can also be used to power other switching apparatus, (not shown) and cause the fan at 6 FIG. 1 to stop, or set the fan to operate at a slow speed during the defrost cycle.

When the defrost cycle is finished and power is removed from the solenoid, 22 FIG. 2, power will be removed from the microwave energy means, 20 FIG. 1, and the heat pump will continue to operate in the heating mode until the system is turned off, or changed to the air conditioning mode.

It should be noted that microwave energy released into a metallic enclosure such as that shown at 18 FIG. 1, can damage a magnetron tube, or other microwave energy generating device when there is no moisture within the enclosure to absorb such microwave energy. However, it is unlikely that the enclosure shown at 18 FIG. 1, would not contain some amount of moisture at any time when the heat pump is operating in the heating mode. Them is usually a sufficient amount of humidity present in ambient air to cause some condensation on the cold external surfaces of the outside coil of an electric heat pump. In fact, this is what causes the outside coil to accumulate frost in the first place. On the other hand, it is possible that the enclosure will become completely devoid of moisture during a defrost cycle using the present invention, and for that reason alone, it is necessary to provide some kind of humidity controlled circuit breaker such as that shown at 16 FIG. 1, to assure that the system is not energized when no moisture exist within the enclosure.

As stated earlier herein, the device at 21 FIG. 2 is not a part of the present invention. It is in fact a system already in use to determine when an electric heat pump requires defrosting, and is thus used to activate and de-activate the reversing valve in heat pumps of the prior art in order to start, and stop the defrost cycle. When incorporated with the present invention, such systems are not employed to activate and de-activate the reversing valve of the heat pump, but instead are used to open and close a segment of the power circuit shown at FIG. 2. Some of these devices are simple timers which act to defrost the outside coil of an electric heat pump of the prior art at timed intervals whither the system needs defrosting or not. Other systems use a variety of sensors designed to defrost the coil only when certain temperature and pressure requirements are met. In some cases, the use of these systems, especially one that employs temperature and pressure sensing devices to control the defrost cycle, could eliminate the need for certain parts of the control system shown at FIG. 2. However, some kind of device such as the humidity controlled circuit breaker shown at 16 FIG. 1, would be required.

It should be noted that microwave energy travels in a straight line in an open atmosphere at speeds approaching the speed of light. Inside a metallic enclosure such as that shown at 18 FIG. 1, a wave of such energy will bounce around in all directions, reflecting from the metal surfaces of the screen, or the tubing and flanges of the outside coil of the heat pump, until the wave comes into contact with moisture, where it can be absorbed.

Since the outside coil of an electric heat pump usually collects frost on all its external surfaces, including the surfaces of the tubing and flanges on both sides, as well as on the surfaces of the tubing and flanges within, the tubing and flanges of the coil should be spaced further apart than is the usual practice so that microwave energy can enter between the tubing and flanges to the core of the coil. Also, the outside coil of the heat pump should be placed in the enclosure 18, in a manner that would leave some open space between the outside coil and the walls of the enclosure. Space should be left on the top, the bottom, and both sides of the outside coil. This will allow microwave energy to move around the coil and approach the coil from the back side.

It will be understood that particular care should be taken in the selection of the microwave energy means recommended in the foregoing. Although other devices are available to generate microwave energy, the magnetron tube appears to be the device most often used to create heat in apparatus such as microwave ovens. As stated earlier herein, heat is actually created by microwave energy, when it is absorbed into a molecular a substance such as water. Obviously, the size and power capacity of the microwave energy generating device to be used in the implementation of the present invention will depend on the size of the outside coil of the heat pump, the size and capacity of the enclosure in which the coil is housed, and the amount of frost and/or ice allowed to accumulate thereon before the defrost cycle is initiated. As a matter of fact, in some cases, two or more magnetron tubes, or other microwave energy generating devices may be required to product a sufficient amount of heat to rapidly defrost the outside heat exchanger coil of a large electric heat pump system.

In reference to the wave guide shown at 15 FIG. 1, it will be understood that the size and shape of the tube or channel used to form the wave guide will depend upon the frequency of the microwave energy produced by the magnetron tube, or other microwave energy generating device employed. However, the construction of such device is simple and well known, and should not create a significant problem in the design and fabrication of a production model of the present invention.

As stated earlier, the spacing of the tubing and flanges of the outside coil of the heat pump is extremely important. Microwave energy will not enter between metal objects that are closely associated. It is suggested that the tubing be formed in widely spaced layers with at least one inch space between each layer, and each tube. The tubing could be staggered, so that each tube in the second layer would fall between two of the tubes in the first layer, and each tube in the third layer would fall between two of the tubes in the second layer, etc. Also, if flanges are to be used, they should be only wide enough to encompass one layer of tubing, and should be widely spaced so that microwave energy can freely enter between each of the layers, and each of the tubes. As a matter of fact, it is doubtful that flanges are of critical importance in the first place. Test show that the temperature of air exiting a coil without flanges is about the same as the temperature of air exiting a similar coil with flanges. One must remember that heat radiates in open space many thousand times faster that it will conduct through metal. And it is obvious that heat collected on the metal flanges of a typical coil must travel by means of conduction through both the metal of the flange, and the tubing, before it can be absorbed into the refrigerant inside the coil and carried through the heat pump system.

Also, it should be noted that all metal objects within the enclosure shown at 18 FIG. 1 should be securely bonded together. Loosely fined metal parts may cause sparks, and could damage the magnetron tube or other microwave energy generating device.

DESCRIPTION OF AN ALTERNATE VERSION

In an alternate version of the present invention, the microwave system would act as a frost inhibitor only, and would serve to prolong the time between regular defrost cycles in heat pumps utilizing the reverse flow system. Defrosting would be accomplished in the same manner as in the prior art. The device shown at 21, FIG. 2 would be disposed to reverse the flow of refrigerant inside the heat pump system when defrosting is required, causing the inside coil of the heat pump to exchange functions with the outside coil. However, by using the present invention to inhibit the build up of frost on the external surfaces of the outside coil of the heat pump, the system should rarely require defrosting.

Figure 3:
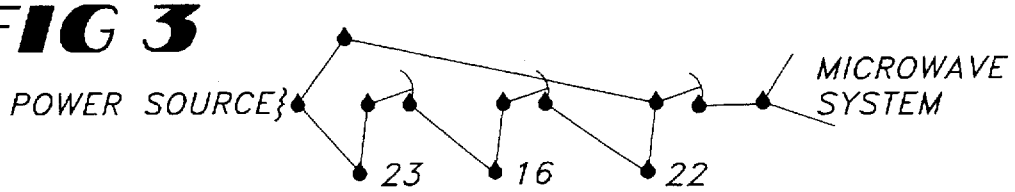
FIG. 3 shows a functional schematic diagram of a control system to operate the microwave energy means shown at 20, FIG. 1 when only the alternate version of the present invention is used.

Turning now to FIG. 3, there is shown a schematic diagram of a system designed to control the operation of the microwave energy means shown at 20 FIG. 1. when only the alternate version of the present invention is used. At 23, there is shown an electric timer switch, at 16, a humidity controlled circuit breaker, (also shown in the drawing at FIG. 1 ) and at 22, a solenoid. Each of the above devices, 23 and 16, serve to open and close a segment of the power circuit disposed to energize the solenoid at 22, which in turn will act to energize the microwave energy means.

When the electric timer reaches a pre-determined time setting, the switch at 23 will close and power will be allowed to pass and flow to the humidity controlled circuit breaker 16 FIG. 1. When circuit breaker 16 determines that sufficient humidity is within the enclosure 18 to absorb the microwave energy, the switch at 16 will close and power will be allowed to pass and flow to the solenoid at 22. When the solenoid 22 is energize, the switch at 22 will dose causing power to flow to the microwave energy means, 20 FIG. 1, and the system will commence to operate much in the same manner as in the regular version of the present invention. The system will operate until the electric timer turns off the power circuit at timer switch 23, and will commence to operate again for a pre-determined amount of time according to the setting of the electric timer.

In this version of the present invention, power leading to the power circuit shown at FIG. 3 should originate at a source that is energized only when the heat pump is operating in the heating mode.

Many changes and modifications could be made to the above. For example, in addition to the electric timer mentioned above, sensing devices could be used to set the power level of the microwave energy means shown at 20 FIG. 1, in a manner that would cause the microwave system to function at a progressively higher power setting as the temperature of the outside coil falls.

Although the disclosed embodiment of the present invention finds utility in a magnetron tube, or other microwave energy generating device for the purpose of defrosting, and/or inhibiting the accumulation of frost on the external surfaces of the outside coil of an electric heat pump, it should be understood that the foregoing relates only to a disclosed embodiment, and numerous changes and modifications may be made therein without departing from the spirit and scope of the present invention as defined in the following claims.

I claim:

1. A heat pump defroster system for the application of heat to the external surfaces of the outside coil of an electric heat pump, comprising:

microwave energy means for generating microwave energy to defrost said outside coil of said heat pump; and enclosure means for housing said outside coil of said heat pump, for receiving said microwave energy, and for preventing said microwave energy from escaping said enclosure means while allowing ambient air to freely flow therethrough; and microwave energy wave guide means for transmitting said microwave energy from said microwave energy means to said enclosure means.

2. The heat pump defroster system of claim 1, further comprising a humidity controlled circuit breaker for deactivating said microwave energy means when humidity within said enclosure means is below a predetermined level.

3. The heat pump defroster system of claim 2, wherein said predetermined level is set at a level where there is an inadequate amount of humidity within said enclosure means to absorb said microwave energy.

4. The heat pump defroster system of claim 1, wherein said microwave energy means is activated when more than a predetermined amount of humidity is present within said enclosure means.

5. The heat pump defroster system of claim 2, wherein said enclosure means encloses said outside coil of said heat pump, and said humidity controlled circuit breaker.

6. The heat pump defroster system of claim 1, wherein said external surfaces of said outside coil of said heat pump is substantially exposed to said microwave energy from said microwave energy means.

7. The heat pump defroster system of claim 1, wherein said microwave energy means is housed in a safe environment, away from excessive moisture.

8. The heat pump defroster system of claim 1, wherein said microwave energy wave guide means is attached to said microwave energy means in a manner that will allow microwave energy to travel through said microwave energy wave guide means, and to be discharged within said enclosure means.

9. The heat pump defroster system of claim 1, wherein said microwave energy means is activated at timed intervals in order to inhibit accumulation of frost on said outside coil of said heat pump.

10. The heat pump defroster system of claim 9, further comprising control means for varying said time intervals and power levels of operation of said heat pump defroster system.

11. The heat pump defroster system of claim 1, wherein microwave energy generated by said microwave energy means, and transmitted to said enclosure means, and applied to the external surfaces of said outside coil of said heat pump will create heat thereon, and act to defrost said outside coil of said heat pump, or act to inhibit the accumulation of frost on the external surfaces of said outside coil of said heat pump; and wherein said heat will be absorbed into said outside coil of said heat pump and used to improve the efficiency of said heat pump.

12. A method for defrosting the outside coil of an electric heat pump, comprising the steps of:

providing a microwave energy means housed in a safe environment away from excessive moisture; and an enclosure means wherein said outside coil of said heat pump is enclosed, along with a humidity controlled circuit breaker;

a microwave energy wave guide means to transmit said microwave energy to said enclosure means: and wherein microwave energy generated by said microwave energy means is transmitted to said enclosure means so as to apply heat to the external surfaces of said outside coil of said heat pump while said heat pump is operating in the heating mode so that said outside coil of said heat pump is defrosted with heat generated by said microwave energy without the need to reverse the flow of refrigerant within said heat pump, and allowing said heat to be absorbed into the heat pump system via the outside coil of said heat pump.

13. The method of claim 12, further including the step of deactivating said microwave energy means when humidity within said enclosure means is below a predetermined level.

14. The method of claim 12, further including the step of periodically energizing said microwave energy means.

* * * * *